US006499443B2

(12) United States Patent
Kawamoto et al.

(10) Patent No.: US 6,499,443 B2
(45) Date of Patent: Dec. 31, 2002

(54) COOLANT PASSAGE STRUCTURE OF V-TYPE LIQUID COOLED ENGINE

(75) Inventors: Yuichi Kawamoto, Akashi (JP); Kiyohito Takano, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/771,849

(22) Filed: Jan. 29, 2001

(65) Prior Publication Data

US 2002/0100434 A1 Aug. 1, 2002

(51) Int. Cl.[7] ..... F01P 5/10
(52) U.S. Cl. ..... 123/41.44; 123/54.4
(58) Field of Search ..... 123/41.44, 41.47, 123/54.4

(56) References Cited

U.S. PATENT DOCUMENTS

| | | | | |
|---|---|---|---|---|
| 4,945,887 A | * | 8/1990 | Sakurai et al. | 123/573 |
| 6,305,332 B1 | * | 10/2001 | Nishi et al. | 123/41.29 |
| 2001/0023668 A1 | * | 9/2001 | Guzman | 123/41.44 |

FOREIGN PATENT DOCUMENTS

| | | |
|---|---|---|
| JP | 62-007937 A | 1/1987 |
| JP | 3-117614 | 5/1991 |
| JP | 04-012108 A | 1/1992 |
| JP | 11-036863 A | 2/1999 |
| JP | 11-294691 A | 10/1999 |

* cited by examiner

*Primary Examiner*—Noah P. Kamen
(74) *Attorney, Agent, or Firm*—Marshall, Gerstein & Borun

(57) ABSTRACT

A coolant passage structure of a small V-type liquid cooled engine is provided for introducing coolant from a water pump to water jackets respectively formed in cylinders and for cooling the cylinders. The water pump is provided in a generator cover placed in a side portion of the engine or in the vicinity of the generator cover. The coolant passage structure includes a coolant passage integrally formed in the generator cover. A water gallery is formed in a crank case of the engine for supplying the coolant to the respective cylinders. The water gallery is located in the vicinity of lower ends of the cylinders and extends in a direction substantially parallel to a crank shaft of the engine between the cylinders. The coolant passage is connected to the water gallery.

9 Claims, 5 Drawing Sheets

COOLANT PASSAGE STRUCTURE OF V-TYPE LIQUID COOLED ENGINE

BACKGROUND OF THE INVENTION

1. Field of the Invention

The present invention relates to a coolant passage structure of a small V-type liquid cooled engine mounted on a motor cycle, a small all terrain vehicle (hereinafter referred to as ATV), a snow mobile, a small leisure vehicle, a personal watercraft, or the like.

2. Description of the Related Art

Small liquid cooled engines (hereinafter also referred to as water cooled engines) are mounted on some of motor cycles, small all terrain vehicles (small ATV), snow mobiles, small leisure vehicles, personal watercrafts, and the like. In these water cooled engines, in general, low-temperature cooling water (coolant) cooled in a radiator is supplied from a water pump rotated by a drive shaft of the engine to water jacket(s) formed around a combustion chamber of the engine.

Conventionally, as described in Japanese Laid Open Patent Publication No. Hei 3-117614, in the small engine, for example, in the engine of the motor cycle, the water pump is placed in a lower portion of the engine and supplies coolant to water jacket(s) formed in engine cylinder(s) placed above the water pump via a hose or the like made of flexible rubber or the like.

In this case, however, the rubber hose around the engine of the motor cycle is visible from outside. These days, superior external appearance, not to mention high performance, is highly demanded of the motor cycle, the small all terrain vehicle, the leisure vehicle, and the like. Therefore, the placement of the rubber hose around the engine makes the entire engine portion complex in appearance regardless of how the external appearance of the engine itself is designed.

In addition, when using the rubber hose, the number of parts and man-hour for assembly of the engine are increased and a manufacturing cost of the engine portion is increased, in addition to the complex appearance described above.

SUMMARY OF THE INVENTION

Under the circumstances, an object of the present invention is to provide a coolant passage structure of a V-type liquid cooled engine, which makes an external appearance of the engine simple, and reduces the number of parts and man-hour for assembly for reduction of a manufacturing cost.

The present invention provides a coolant passage structure of a small V-type liquid cooled engine, wherein a water pump is provided in a cover provided on the engine or in the vicinity of the cover, comprising: a coolant passage provided in the cover for introducing the coolant from the water pump to the water jackets respectively formed in the cylinders of the engine.

With this coolant passage structure, the coolant passes through the coolant passage inside of the cover so that it is supplied from the water pump to the water jackets of the cylinders. Therefore, the conventional rubber hose becomes unnecessary and design of the external appearance of the engine portion can be made simple. In addition, this coolant passage structure makes a portion around the engine simple. Further, since the number of parts and man-hour for assembly of the engine can be reduced, this structure contributes to reduction of the manufacturing cost of the V-type liquid cooled engine.

It is preferable that the coolant passage structure of the small V-type liquid cooled engine, further comprises: a water gallery provided in a branch portion of the coolant passage for supplying the coolant to the respective cylinders arranged in V-shape, for introducing the coolant to the cylinders. With this coolant passage structure, the structure of the branch portion is simplified and the coolant can be supplied to the water jackets of the respective cylinders arranged in V-shape with loss of a pressure lessened.

It is preferable that in the coolant passage structure of the small V-type liquid cooled engine, the cover is a generator cover placed in a side portion of the engine.

It is preferable that in the coolant passage structure of the small V-type liquid cooled engine, the generator cover is attached to a crank case and the water gallery is formed in the crank case.

It is preferable that in the coolant passage structure of the small V-type liquid cooled engine, a rotational shaft of the water pump is identical to a rotational shaft of an oil pump to obtain a compact and reasonable configuration.

DETAILED DESCRIPTION OF THE PREFERRED EMBODIMENTS

A coolant passage structure of a small V-type liquid cooled engine according to an embodiment of the present invention will be described with reference to the accompanying drawings.

Figure 1:
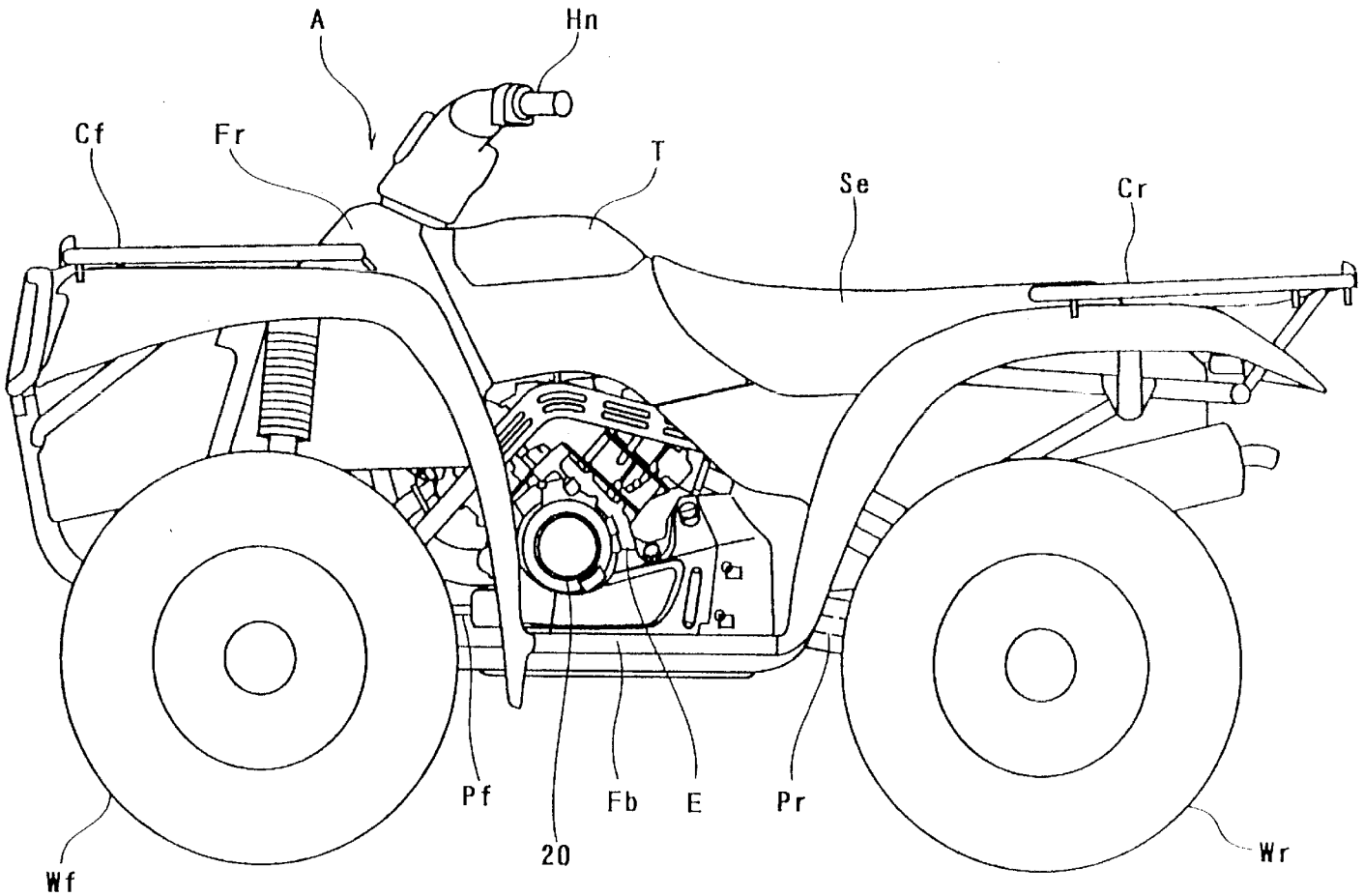
FIG. 1 is a side view showing an entire all terrain vehicle on which an engine having a coolant passage structure of a small V-type liquid cooled engine according to an embodiment of the present invention is mounted.

Referring now to FIG. 1, a straddle-type four wheel all terrain vehicle A comprises a steering bar handle Hn rotatably attached to a vehicle body Fr, right and left front wheels Wf, and right and left rear wheels Wr. The straddle-type four wheel all terrain vehicle A further comprises a forward carrier Cf placed forward of the handle Hn, a cover T placed rearward of the handle Hn such that it covers an air cleaner provided above, a straddle-type seat Se placed rearward of the cover T, a rearward carrier Cr placed rearward of the seat Se, and foot boards Fb provided on opposite sides situated forward and downward of the seat Se and at positions substantially as high as axles of the front wheels Wf and the rear wheels Wr. The vehicle A is provided with a V-type two cylinder OHC four cycle engine (hereinafter referred to as a V-type engine) E below the cover T such that a lower end thereof is substantially as high as the foot boards Fb. Two cylinders of the V-type engine E are placed forward and rearward such that they are inclined to make an angle between them in a forward and rearward direction.

The V-type engine E drives the front wheels Wf or the rear wheels Wr via a torque converter, a transmission gear unit (not shown), a forward output shaft Pf or a rearward output shaft Pr respectively provided in the forward or rearward direction, and a differential unit (not shown).

In so configured straddle-type four wheel all terrain vehicle A, a rider straddles the seat Se, put the rider's feet on the foot boards Fb provided right and left, and grips the handle Hn with both hands to steer the vehicle A.

Figure 2:
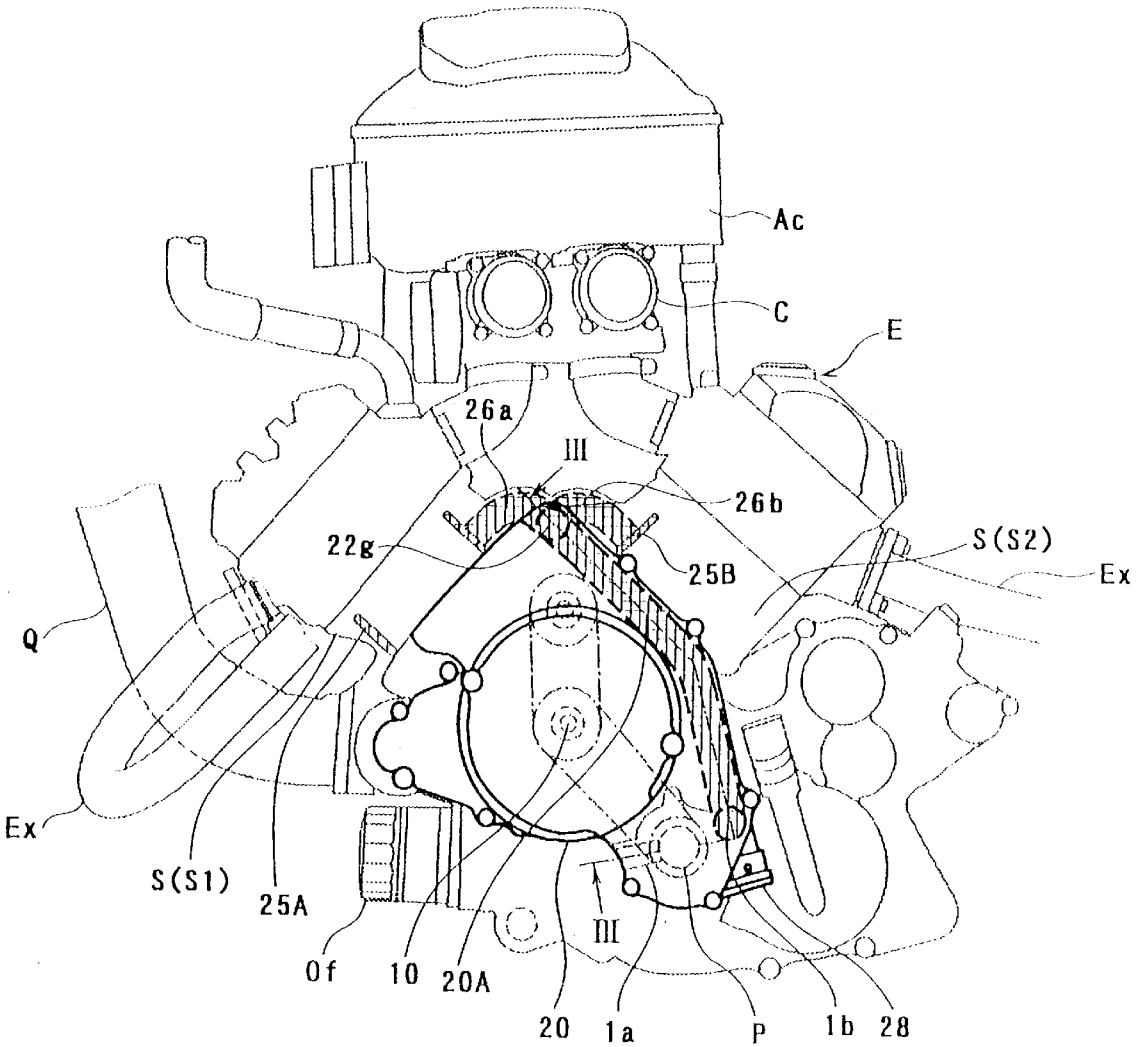
FIG. 2 is a right-side view showing an engine and showing flow of coolant (coolant passage for cooling) from a water pump to cylinders.
Figure 5:
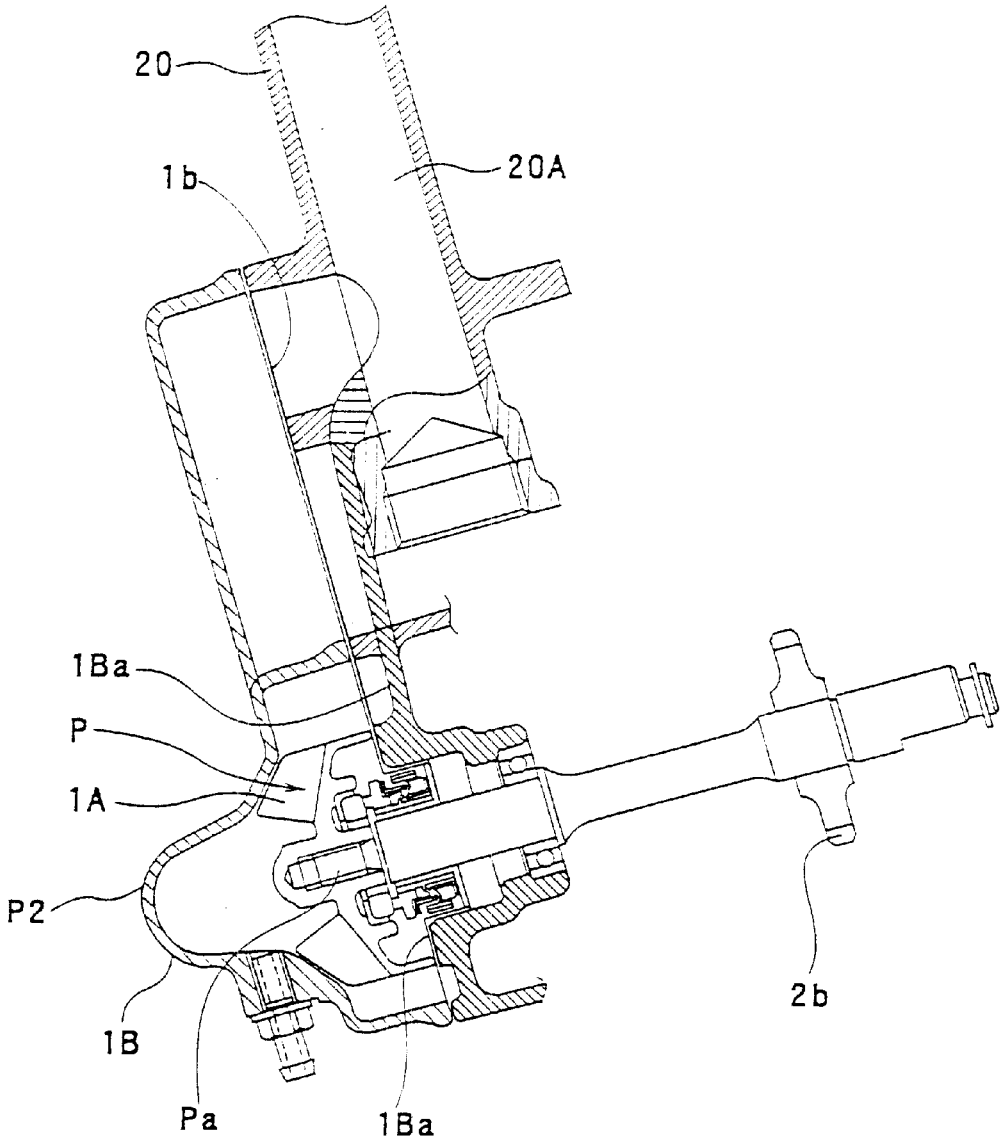
FIG. 5 is a partial cross-sectional view in the direction of the arrow V—V of FIG. 4, showing a structure of a portion of the coolant passage of FIG. 4 connecting the water pump and the cover.

By the way, the V-type engine is a water cooled (liquid cooled) engine. As shown in FIG. 2, a water pump P is provided in a lower end portion of the engine E. As shown in a transverse sectional view of FIG. 3 or in a partial cross-sectional view of FIG. 5, the water pump P comprises an impeller 1A rotatably disposed in a central portion thereof, and a pump chamber 1B including a suction port 1*a* and a discharge port 1*b* and covering the impeller 1A. In this embodiment, an outside outer wall of the pump chamber 1B is formed by a cover P2 of the water pump P.

The impeller 1A is driven by power from a crank shaft 10. Thereby, as shown in FIG. 2, the coolant is suctioned from the suction port 1*a* communicating with a radiator (not shown) placed in a forward portion of the vehicle body and is discharged to water jackets 25 (25A, 25B) formed in the cylinders S of the engine E through the discharge port 1*b*.

Figure 4:
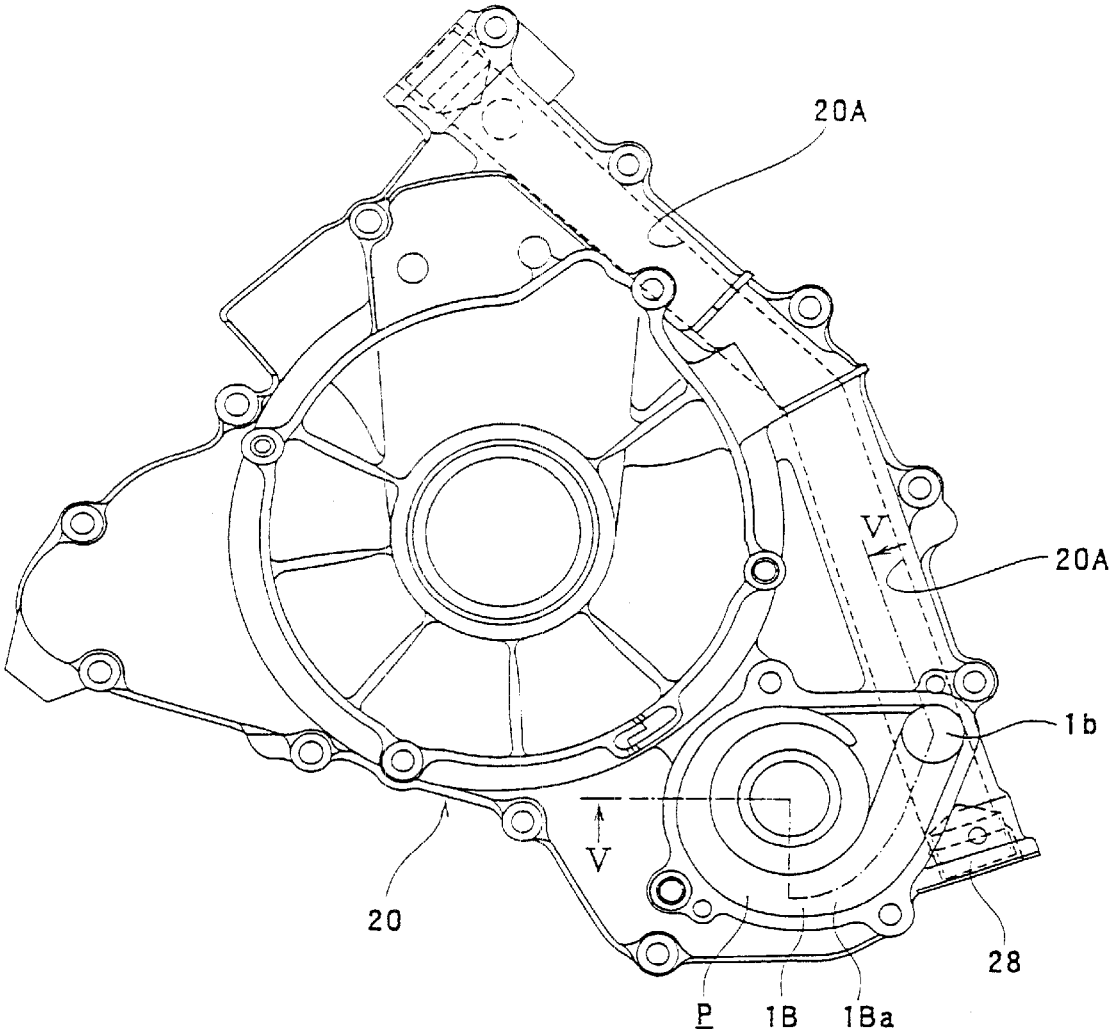
FIG. 4 is a side view showing a structure of the coolant passage, shown in FIGS. 2, 3, which is formed in a generator cover and is represented by dotted lines, and showing a state in which a cover and an impeller of the water pump are detached.

An outer wall 1B*a* and the discharge port 1*b* of the pump chamber 1B shown in FIG. 4 are formed by utilizing a portion of a generator cover 20 provided on the side portion of the engine.

The generator cover 20 is provided with a coolant passage (water passage) 20A having a circular cross section, which communicates with the discharge port 1*b* of the pump chamber 1B. The coolant passage 20A is formed integrally with the generator cover 20. More specifically, the coolant passage 20A is provided in an outer peripheral portion of the generator cover 20 such that it constitutes a portion of the generator cover 20 and extends from an exit of the discharge port 1*b* of the pump chamber 1B to a vicinity of lower ends of the cylinders S of the engine as shown in FIG. 2. The coolant passage 20A communicates with a water gallery 22*g* formed integrally with a crank case 22 in the vicinity of the lower ends of the cylinders S.

Figure 3:
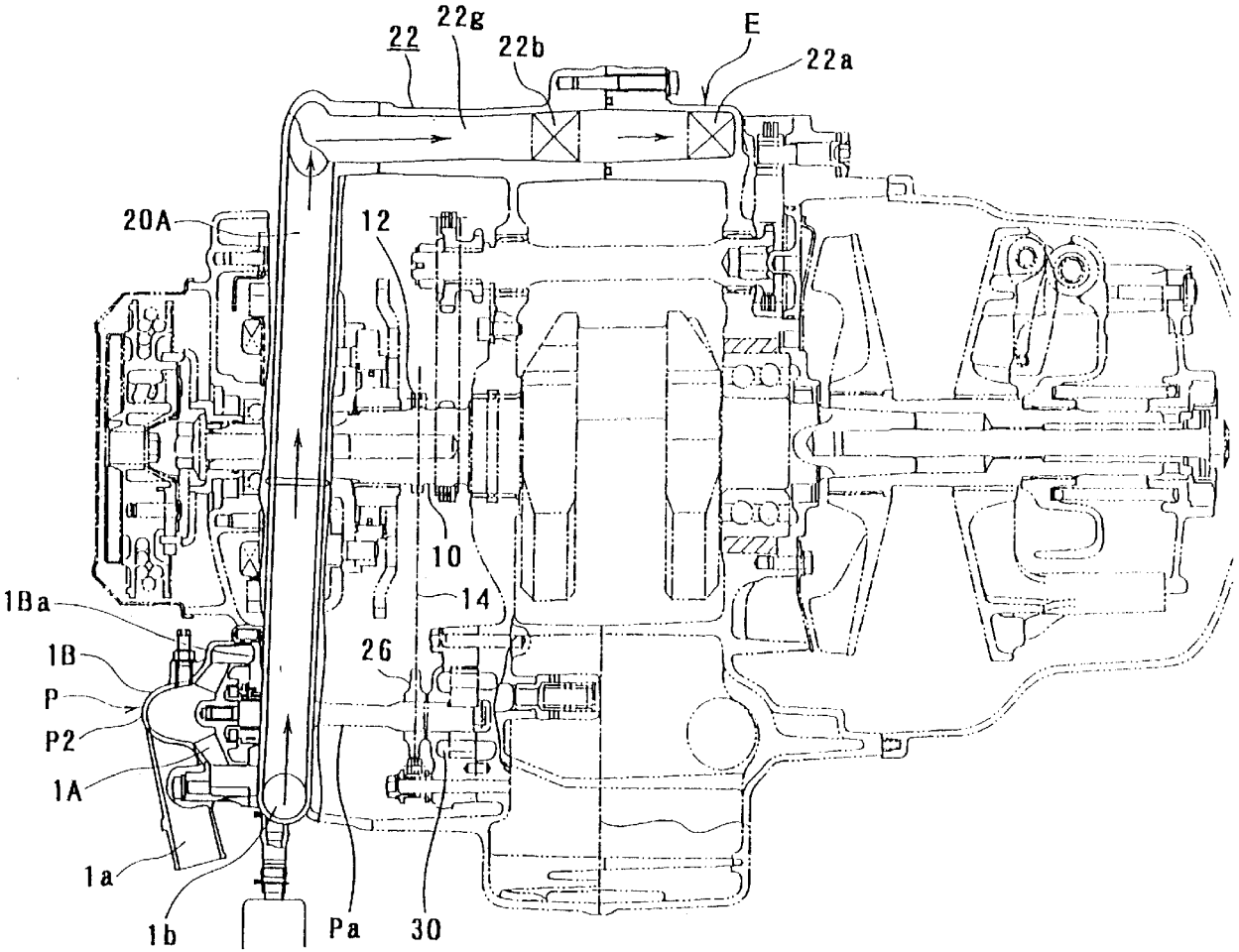
FIG. 3 is a cross-sectional view in the direction of the arrow III—III of FIG. 2.

The water gallery 22*g* extends in a direction substantially parallel with the crank shaft 10 as shown in FIG. 3 between the cylinders S1, S2 arranged in V-shape and placed forward and rearward (right and left in FIG. 2) and adjacently to each other such that it connects coolant passages of the cylinders S1 and S2. Therefore, the water gallery 22*g* is bent at an angle of substantially 90 degrees with respect to the coolant passage 20A. That is, the water gallery 22*g* extends from an upper end portion of the coolant passage 20A toward a rear face of FIG. 2.

As shown in FIG. 3, the water gallery 22*g* has a coolant passage hole 22*a* communicating with the water jacket 25A (see FIG. 2) of the first cylinder S1 (see FIG. 2) inclined forward in the vehicle body and a coolant passage hole 22*b* communicating with the water jacket 25B (see FIG. 2) of the second cylinder S2 (see FIG. 2) placed rearward of the first cylinder S1. As shown in FIG. 2, these coolant passage holes 22*a*, 22*b* communicate with cylinder coolant passages 26*a*, 26*b* respectively formed in the cylinders S1, S2, and consequently communicate with the water jackets 25A, 25B, respectively.

In brief, the coolant passage of the V-type liquid cooled engine according to this embodiment, entirely passes through the inside from the generator cover 20 to the crank case 22. In FIGS. 2, 4, reference numeral 28 denotes a lid member for sealing an end portion of the coolant passage 20A. The lid member 28 serves to cover an opening portion required for die-casting the coolant passage 20A integrally with the generator cover 20.

In this embodiment,. as shown in FIG. 3, a rotational shaft Pa of the water pump P is rotatably supported by the generator cover 20 and is extended inwardly of the engine E. This extended portion constitutes a rotational shaft of an oil pump 30 for lubrication of the engine E. That is, the water pump P and the oil pump 30 share the rotational shaft Pa. The rotational shaft Pa is provided with a sprocket 26 integrally. The sprocket 26 is connected to a sprocket 12 provided integrally with the crank shaft 10 by means of a chain 14. Therefore, upon rotation of the crank shaft 10, the water pump P and the oil pump 30 are actuated.

While in this embodiment, the coolant passage 20A is integrally formed in the generator cover 20, it may be integrally formed in another cover which is provided in a side portion of the crank case, according to placement of the generator cover 20. In addition, the number of the covers is not limited to one and two or more covers may be used for the cover.

In FIG. 2, reference C denotes a carburetor, Ac denotes an air cleaner, Q denotes a cooling tube for supplying cooling air to a belt converter, Ex denotes an exhaust pipe, and Of denotes an oil filter of the engine.

When the coolant passage structure according to the present invention is adopted in the ATV or the like in which a side portion of the engine is visible seen in a side view, the hose or the like for the coolant becomes unnecessary. For this-reason, this coolant passage structure is especially effective because design of the external appearance of the engine portion can be made simple.

When the water pump is placed in the lower portion of the engine that is apart from the cylinders like this embodiment, the coolant passage can be manufactured easily and at a low cost by forming the coolant passage using the cover such as the generator cover as described above.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A coolant passage structure of a small V-type liquid cooled engine for introducing coolant from a water pump to water jackets respectively formed in cylinders and cooling the cylinders, wherein the water pump is provided in a generator cover placed in a side portion of the engine or in the vicinity of the generator cover, the structure comprising:

a coolant passage integrally formed in the generator cover for introducing the coolant from the water pump to the water jackets respectively formed in the cylinders; and a water gallery formed in a crank case, for supplying the coolant to the respective cylinders arranged in V-shape, the water gallery being located in the vicinity of lower ends of the cylinders and extending in a direction substantially parallel to a crank shaft of the engine between the cylinders, wherein the coolant passage is connected to the water gallery.

2. The coolant passage structure of the small V-type liquid cooled engine of claim 1, wherein the coolant passage is provided in an outer peripheral portion of the generator cover.

3. The coolant passage structure of the small V-type liquid cooled engine of claim 2, wherein the generator cover is attached to the crank case of the engine.

4. The coolant passage structure of the small V-type liquid cooled engine of claim 1, wherein a rotational shaft of the water pump is identical to a rotational shaft of an oil pump.

5. A coolant passage structure of a small V-type liquid cooled engine for introducing coolant from a water pump to water jackets respectively formed in cylinders and cooling the cylinders, wherein the water pump is provided in a cover provided on the engine or in the vicinity of the cover, and located below a crank shaft of the engine, the structure comprising:

a coolant passage integrally formed in the cover for introducing the coolant from the water pump to the water jackets respectively formed in the cylinders; and a water gallery formed integrally with a crank case in the vicinity of lower ends of the cylinders, having a branch portion for supplying the coolant to the respective cylinders and extending in a direction substantially parallel to the crank shaft of the engine between the cylinders, wherein the coolant passage is connected to the water gallery.

6. The coolant passage structure of the small V-type liquid cooled engine of claim 5, wherein the cover is a generator cover placed in a side portion of the engine for accommodating a generator.

7. The coolant passage structure of the small V-type liquid cooled engine of claim 6, wherein the coolant passage is provided in an outer peripheral portion of the generator cover.

8. The coolant passage structure of the small V-type liquid cooled engine of claim 6, wherein the generator cover is attached to the crank case of the engine.

9. The coolant passage structure of the small V-type liquid cooled engine of claim 6, wherein a rotational shaft of the water pump is identical to a rotational shaft of an oil pump.

* * * * *